US007377307B1

(12) United States Patent
Ijiri et al.

(10) Patent No.: US 7,377,307 B1
(45) Date of Patent: May 27, 2008

(54) VERTICAL HEAT EXCHANGER

(75) Inventors: Yuichi Ijiri, Himeji (JP); Takeshi Nishimura, Himeji (JP); Kazuhiko Sakamoto, Himeji (JP); Osamu Dodo, Hyogo (JP)

(73) Assignee: Nippon Shokubai Co., Ltd. (JP)

( * ) Notice: Subject to any disclaimer, the term of this patent is extended or adjusted under 35 U.S.C. 154(b) by 245 days.

(21) Appl. No.: 09/705,351

(22) Filed: Nov. 3, 2000

(30) Foreign Application Priority Data

Nov. 8, 1999 (JP) ..... 11-316504

(51) Int. Cl.
*F28F 27/00* (2006.01)

(52) U.S. Cl. ..... 165/134.1; 165/70; 165/71; 165/139; 165/100; 165/157; 165/158; 165/278; 422/201; 422/205

(58) Field of Classification Search ..... 165/157, 165/158, 71, 70, 134.1, 139, 100, 278; 422/201, 422/205

See application file for complete search history.

(56) References Cited

U.S. PATENT DOCUMENTS

| | | | | | |
|---|---|---|---|---|---|
| 201,181 | A | * | 3/1878 | Huges | 165/71 |
| 808,385 | A | * | 12/1905 | Kieren | 165/71 |
| 1,848,197 | A | * | 3/1932 | Ray et al. | 165/71 |
| 2,181,704 | A | * | 11/1939 | McNeal | 165/114 |
| 2,589,733 | A | * | 3/1952 | Rosenblad | 165/71 |
| 3,520,661 | A | * | 7/1970 | Grobe et al. | |
| 4,158,387 | A | * | 6/1979 | McDonald | 165/71 |
| 4,202,406 | A | * | 5/1980 | Avery | 165/71 |
| 4,236,576 | A | * | 12/1980 | Deuse et al. | 165/134.1 |
| 4,562,887 | A | * | 1/1986 | Muri | 165/158 |
| 4,770,239 | A | * | 9/1988 | Duponteil | 165/134.1 |
| 5,035,283 | A | * | 7/1991 | Brucher et al. | 165/134.1 |
| 5,048,601 | A | * | 9/1991 | Yamaguchi et al. | 165/158 |
| 6,582,667 | B1 | * | 6/2003 | Ogata et al. | 422/201 |

FOREIGN PATENT DOCUMENTS

| | | | | |
|---|---|---|---|---|
| JP | 55-43354 | * | 3/1980 | 165/158 |
| JP | 55043354 A | * | 3/1980 | |

OTHER PUBLICATIONS

Lord, R.C. et al., "Guide to Trouble-Free Heat Exchangers", Chemical Engineeering, Jun. 1, 1970, pp. 153-160.
Shah, G.C., "Troubleshooting Reboiler Systems", Chemical Engineering Progress (CEP), Jul. 1979, pp. 53-58.
Kister, Henry Z., Distillation Operation, pp. 153-160, McGraw-Hill, Inc., 1990.

* cited by examiner

*Primary Examiner*—John K. Ford
(74) *Attorney, Agent, or Firm*—Mathews, Shepherd, McKay & Bruneau, P.A.

(57) ABSTRACT

A vertical heat exchanger is described, which allows efficient elimination of the gas generated therein and efficient removal of the sludge accumulated therein. The vertical heat exchanger has at least part of one end of a vent pipe formed of an upper tube sheet part (an upper cover part in the case of a spiral heat exchanger) and the other end thereof connected outside the heat exchanger to an immediately adjacent fluid passing port passing the same fluid as the vent and/or at least part of one end of a drain pipe formed of a lower tube sheet part (a lower cover part in the case of a spiral heat exchanger) and the other end thereof connected outside the heat exchanger to an immediately adjacent fluid passing port passing the same fluid as the drain.

4 Claims, 7 Drawing Sheets

VERTICAL HEAT EXCHANGER

BACKGROUND OF THE INVENTION

1. Field of the Invention

This invention relates to a vertical heat exchanger and a method for the use of the heat exchanger.

2. Description of the Related Art

FIG. 1 is a cross section of the general shell-and-tube heat exchanger. Heretofore, it has been customary for a vent pipe 6 to be mounted on the shell, as illustrated in FIG. 1, below an upper tube sheet 8 of a heat exchanger 1 because it is welded as by using a reinforcing ring for the purpose of making up the strength of an opening part thereof and is inevitably required to have a certain distance from the tube sheet. In such a vertical heat exchanger, a high-temperature fluid such as liquid is introduced from a tube side fluid passing port 2 and drawn out from another tube side fluid passing port 3, and conversely a low-temperature fluid such as liquid is introduced from a shell side fluid passing port 4 and drawn out from another shell side passing port 5. In this case, the vent pipe 6 and a drain pipe 7 are not connected to a pipeline. At the time of start, the drain pipe 7 is closed, the vent pipe 6 opened to expel the entrapped gas from the shell, and then during the course of normal operation the drain pipe 7 and vent pipe 6 are both closed.

In this method, however, a gas portion occurs between the vent pipe 6 and the upper tube sheet 8, with the result that a heat-transmission area will be decreased and a thermal efficiency will be lowered in this part of the exchanger. In addition, this gas portion in the gas-liquid phase boundary sometimes induces corrosion of the inner part of the exchanger and the outer part of the tubes.

When the operation of the shell-and-tube heat exchanger is stopped, the drain pipe 7 is utilized to discharge sludge or liquid collected in the shell. This drain pipe 7 is however welded as by using a reinforcing ring adapted for making up the strength of an opening part of the shell and is required to have the allowance of a certain distance from the tube sheet, i.e., the drain pipe 7 is disposed at a level higher than a lower tube sheet 9, so that the sludge accumulated in the part lower than the drain pipe 7 cannot be discharged. In the bottom part of the heat exchanger, sludge is constantly accumulated or part of liquids remains.

Spiral heat exchangers also entail the same problem as the shell-and-tube heat exchangers.

SUMMARY OF THE INVENTION

It is, therefore, an object of this invention to solve the problem of the prior art mentioned above and provide a vertical heat exchanger improved in heat transfer efficiency and in resistance to corrosion.

It is another object of this invention to provide a method for the use of this heat exchanger.

For the purpose of solving the problem mentioned above, in the shell-and-tube heat exchanger, the fluid such as liquid is preferably passed upward in the shell in consideration of the piling up of gases. In other words, as illustrated in FIG. 1, a high-temperature fluid such as liquid is conventionally introduced from a tube side liquid passing port 2 and drawn out from another tube side fluid passing port 3, and conversely a low-temperature fluid such as liquid is introduced from a shell side fluid passing port 4 and drawn out from another shell side passing port 5. In this way, in the part higher than the vent pipe 6, a liquid part is not readily formed but a gas portion is inevitably formed. We have found that, by providing a vent pipe to the upper tube sheet 8 of the heat exchanger or utilizing a bent vent pipe and further connecting the vent pipe with the shell side liquid passing port 5, and consequently loading a back pressure on the connected pipeline, the gas accumulated in the upper part of the shell will be expelled through a nozzle, newly formed in the pipeline, thereby repressing the decease in heat transfer area to improve the heat transfer efficiency and preventing the corrosion possibly arisen on the gas-liquid phase boundary. As a result, this invention has been achieved.

The objects of this invention are achieved by a vertical heat exchanger characterized in that at least part of one end of a vent pipe is made with an upper tube sheet part (an upper cover part in the case of a spiral heat exchanger) and the other end thereof connected outside the heat exchanger to an immediately adjacent fluid passing port passing the same fluid as the vent and/or at least part of one end of a drain pipe is made with a lower tube sheet part (a lower cover part in the case of a spiral heat exchanger) and the other end thereof connected outside the heat exchanger to an immediately adjacent fluid passing port passing the same fluid as the drain.

The objects of this invention are further achieved by a vertical heat exchanger characterized by being provided with a vent pipe fixed on the shell of the heat exchanger, one end of which is disposed beneath an upper tube sheet (an upper cover in the case of a spiral heat exchanger) and the other end of which is connected outside the heat exchanger to an immediately adjacent fluid passing port passing the same fluid as the vent and/or a drain fixed on the shell of the heat exchanger, one end of which is disposed above a lower tube sheet (a lower cover in the case of a spiral heat exchanger) and the other end of which is connected outside the heat exchanger to an immediately adjacent fluid passing port passing the same fluid as the drain.

The objects of this invention are further achieved by a method for the use of the vertical heat exchanger, characterized by introducing or extracting part or the whole of a fluid through the drain pipe of the vertical heat exchanger.

Further, the objects of this invention are achieved by a method for the use of the vertical heat exchanger, characterized by introducing or discharging part or the whole of a fluid through the vent pipe of the vertical heat exchanger.

According to the present invention, the gas collected in the upper part of the heat exchanger will be effectively removed by forming at least part of the vent pipe with the upper tube sheet part (the upper cover part in the case of the spiral heat exchanger) and further connecting the vent pipe to the shell side fluid passing port and/or the fluid in the lower part of the heat exchanger will be fluidized, the overall heat exchange efficiency of the heat exchanger will be improved, and the sludge accumulated in the lower part of the heat exchanger during the suspension of heat exchange will be discharged by forming at least part of the drain pipe with the lower tube sheet part (the lower cover part in the case of the spiral heat exchanger) and further connecting the drain pipe to the shell side fluid passing port.

Also by replacing the conventional vent pipe or drain pipe with a bent pipe, the gas collected in the upper part of the heat exchanger will be effectively removed or the fluid in the lower part of the heat exchanger will be fluidized, the overall heat exchange efficiency of the heat exchanger will be improved, and further the sludge collected in the lower part of the heat exchanger during the suspension of heat exchange will be discharged.

Heretofore, formation of a polymer has been observed on the tube side in the shell-and-tube heat exchanger or on the lower cover part in the spiral heat exchanger. This invention is capable of repressing the occurrence of a polymer.

The above and other objects, features and advantages of the present invention will become clear from the following description of the preferred embodiments.

BRIEF DESCRIPTION OF THE DRAWINGS

The accompanying drawing incorporated in and forming a part of the specification, illustrates several aspects of the present invention, and together with the description serve to explain the principles of the invention. In the drawings.

DESCRIPTION OF THE PREFERRED EMBODIMENTS

Figure 1:
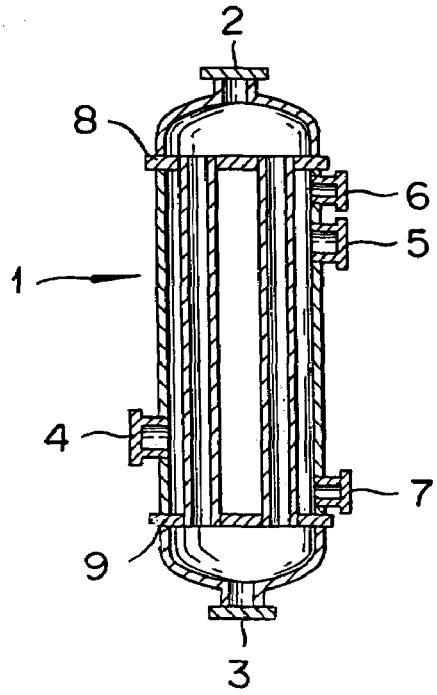
FIG. 1 PRIOR ART
FIG. 1 is a cross section of the conventional shell-and-tube heat exchanger.

The vertical heat exchanger to be used in this invention is generally provided with a vent pipe and a drain pipe. The vent pipe is intended to discharge such gases as entrained by a fluid like water or formed during the course of heat exchange and accumulated in the upper part of the shell (hereinafter referred to as "gas"), and the drain which is intended to discharge such sludge as entrained by such fluids as steam and water and accumulated in the lower part of the shell. The term "vertical heat exchanger" as used herein refers to a known shell-and-tube heat exchanger with a multiplicity of tubes set inside the heat exchanger as laid in the vertical direction, and a known spiral heat exchanger with an upper and lower covers set in the horizontal direction and these covers being provided with inlets and outlets for a fluid, eg. two spiral heat exchangers in which 1) a fluid directed from the outer periphery toward the inner center and another fluid directed from the inner center toward the outer periphery jointly form a spiral counter flow and 2) a fluid is directed in the form of a spiral flow toward the inner center and another fluid is advanced in an axial direction and then directed as condensed in the form a spiral flow toward the outer periphery and ultimately caused to form a counter flow with the first fluid.

In this invention, at least part of one end of the vent pipe, which exists in the interior of the heat exchanger, is formed with the upper tube sheet part (the upper cover part in the case of the spiral heat exchanger). To be specific, the means of forming the vent pipe with the upper tube sheet or forming part of the vent pipe with the upper tube sheet or optionally mounting the pipe by a known method such as welding may be cited. The other end of the vent pipe, which exists outside the heat exchanger, is connected to an immediately adjacent fluid passing port flowing the same fluid as the vent. The fluid passing port is not particularly restricted but only required to be capable of passing a fluid. A hollow pipe itself and a pipe fitted at the opposite ends with flanges may be cited. The expression "immediately adjacent fluid passing port" as used herein refers to an outlet or an inlet for a fluid which is disposed on the shell in the shell-and-tube type heat exchanger or an outlet or an inlet for a fluid which is disposed on the side surface in the spiral heat exchanger. The term "tube sheet" refers to not only a tube sheet itself but also a tube sheet inclusive of such accessorial parts as flanges.

At least part of one end of the drain pipe, which exists in the interior of the heat exchanger, is formed with the lower tube sheet (the lover cover part in the case of the spiral heat exchanger). To be specific, the means for forming the drain pipe with the lower tube sheet, forming part of the drain pipe with the lower tube sheet, or optionally mounting the tube by a known method such as welding may be cited. The other end of the drain pipe, which exists outside the heat exchanger, is connected to the immediately adjacent fluid passing port passing the same fluid as the drain. The fluid passing port, the immediately adjacent fluid passing port, and the tube sheet described herein have the same definitions as those of the vent pipe mentioned above.

The pipe such as the vent pipe or the drain pipe is not particularly restricted so long as it is capable of expelling a gas or sludge. Such known materials as hollow pipes and nozzles may be used.

The angle between the vent pipe (or drain pipe) and the immediately adjacent fluid passing port which passes the same fluid as the vent (or drain), viewed from the axial direction of the heat exchanger, is fixed at the smallest magnitude allowable from the viewpoint of welding and pipe arrangement. Such an angle is preferable not less than 10°. Though one drain pipe is generally provided, a plurality of drain pipes may be provided in consideration of the size of the heat exchanger and the nature of the fluid to be used.

Optionally, by tilting the heat exchanger itself to an extent incapable of inducing a drift current in the case of discharging the gas collected in the heat exchanger through the vent pipe, the vent pipe may be positioned at the highest part so as to facilitate the discharge of the gas collected in the heat exchanger. By the same manner, the drain pipe positioned in the lowermost part facilitates the discharge of the sludge accumulated in the heat exchanger.

Further, the inside diameter (D) of the shell of the heat exchanger, the inside diameter (d) of the vent pipe, and the number (N) of vent pipes are generally preferred to satisfy the following formula: $D/(d \times N)=10\text{-}60$, particularly 10-40.

Of course, the diameters of the shell and vent pipe have the same denomination. As respects the installation of vent pipes, from the viewpoint of improving the heat transfer efficiency and the resistance to corrosion, the number of vent pipes is preferably as large as possible to expel the accumulated in the shell. If the ratio is less than 10, the shortage will be at a disadvantage in imposing a limit on the number of vent pipes from the standpoint of manufacture or pipe arrangement. Conversely, if the ratio exceeds 60, the excess will be at a disadvantage in preventing thorough extraction of the trapped gas, lowering the heat transfer efficiency, and inducing the phenomenon of corrosion. Thus, the fulfillment of the formula given above may be necessary.

This invention embraces a mode of substituting a bent pipe for the conventional vent pipe or drain pipe. By using the bent pipe such as a L-shaped pipe, the gas accumulated in the upper part of the shell can be discharged fully because one end of the vent pipe can be disposed beneath the upper tube sheet even when the vent pipe is mounted on the shell at a position separated from the upper tube sheet. Incidentally, the cut edge of the one end of the bent pipe approximating closely to the upper tube sheet is not particularly restricted so long as it is capable of discharging the gas collected in the upper part of the shell. It may assume any arbitrary angle such as right angle or acute angle relative to the direction of length of the bent pipe. The vent pipe has been described and this description similarly applies to the drain pipe.

Part or the whole of the fluid is preferably introduced or discharged through the drain pipe of the heat exchanger. When the drain pipe is used instead of the shell side fluid passing port, the fluid in the lower part of the heat exchanger can be stirred as fluidized since the drain pipe is positioned at the lowermost part in the shell. When the drain pipe has a relatively small inside diameter, it is incapable of flowing the whole volume of the fluid. By constantly flowing or intermittently flowing part of the fluid, however, it is possible to impart fluidity to the fluid in the lower part of the heat exchanger.

Part or the whole of the fluid is preferably introduced or discharged through the vent pipe of the heat exchanger. When the vent pipe is used instead of the shell side fluid passing port, the gas collected in the heat exchanger can be directly discharged since the vent pipe is positioned in the highest part on the shell of the heat exchanger. When the vent pipe has a relatively small inside diameter, it is incapable of flowing the whole volume of the fluid. By constantly flowing or intermittently flowing part of the fluid, however, it is possible to expel the gas generated in the heat exchanger.

In the use of vertical heat exchangers of this invention for the treatment of heat exchange as in the production of an easily polymerizable substance such as (meth)acrylic acid, an aqueous solution thereof and an ester thereof, the use of this easily polymerizable substance as one of the two fluids subjected to the heat exchange results in substantially decreasing the formation of polymer and effectively fulfilling the heat exchange. The term "aqueous solution" as used herein means a mixture of water and (meth)acrylic acid or esters thereof. Examples of the (meth)acrylic esters may include hydroxyethyl (meth)acrylate, hydroxypropyl (meth) acrylate, glucidyl (meth)acrylate, butyl (meth)acrylate, methyl (meth)acrylate, ethyl (meth)acrylate, 2-ethylhexyl (meth)acrylate, and N,N-dimethylaminoethyl acrylate.

Now, this invention will be described more specifically below with reference to the drawings. No particular restriction is imposed on the directions of flow of the fluids. The outlets and inlets for such fluids may be arbitrarily set, depending on the natures of the fluids to be used for the heat exchange.

Figure 2:
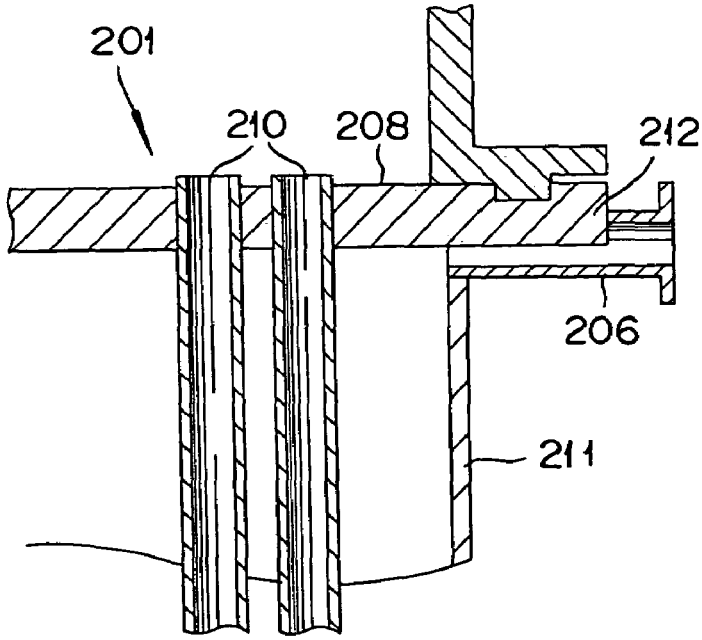
FIG. 2 is a partially cutaway longitudinal cross section of a shell-and-tube heat exchanger according to this invention.

FIG. 2 is a partially cutaway longitudinal cross section of the shell-and-tube heat exchanger according to this invention. Specifically, it is an explanatory diagram illustrating one position for mounding the vent pipe. With reference to FIG. 2, pluralities of tubes 210 are arrayed in the vertical direction, i.e. parallelly to a shell 211 in a heat exchanger 201. One end of a vent pipe 206 is fixed through a flange 212 to a boundary between an upper tube sheet 208 and the shell 211 of the heat exchanger in the state of allowing the inner surface of the vent pipe 206 to confront the upper tube sheet 208 and permitting discharge of the gas collected in the shell 211.

Figure 3:
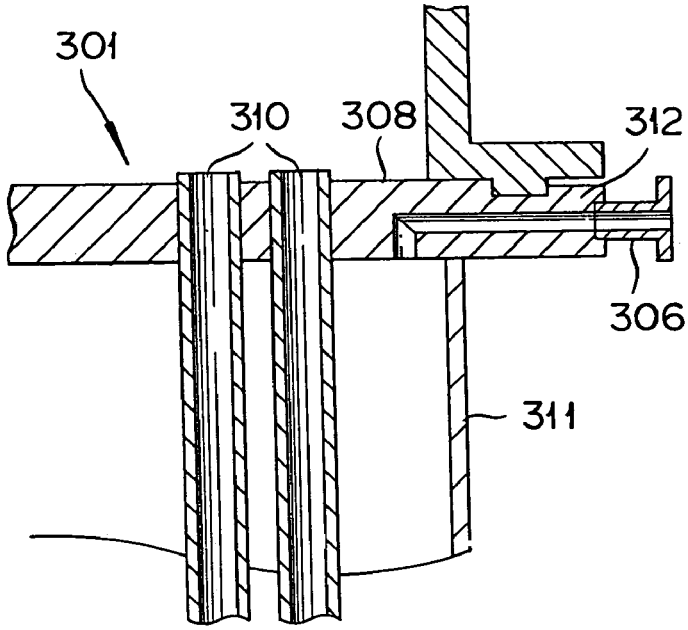
FIG. 3 is a partially cutaway longitudinal cross section of another shell-and-tube heat exchanger according to this invention.

FIG. 3 is a partially cutaway longitudinal cross section of the shell-and-tube heat exchanger according to this invention. Specifically, it is an explanatory diagram for illustrating the other position for mounting the vent pipe. With reference to FIG. 3, pluralities of tubes 310 are arrayed in the vertical direction, i.e. parallelly to a shell 311 of the heat exchanger 301. One end of the bent 306, after piercing a flange 312 and an upper tube sheet 308 and reaching the interior of a heat exchanger 301, is so mounted as to permit discharge of the gas collected in the heat exchanger 301.

Figure 4:
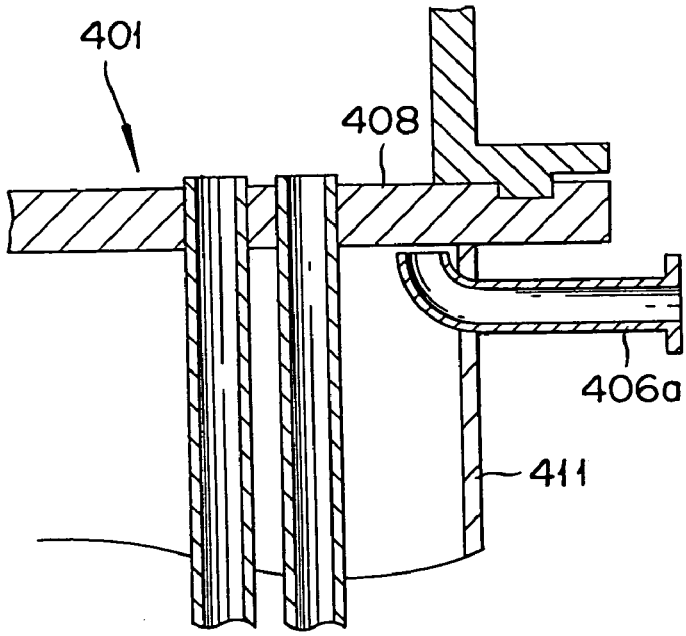
FIG. 4 is a partially cutaway longitudinal cross section of yet another shell-and-tube heat exchanger according to this invention.

The form of the vent pipe, besides what has been described above, may embrace the mode of using a bent pipe and disposing one end of this bent pipe beneath the upper tube sheet. The vent pipe illustrated in FIG. 4 may be cited as an example of just mentioned. FIG. 4 is a partially cutaway longitudinal cross section of the shell-and-tube heat exchanger according to this invention. Specifically, it is an explanatory diagram illustrating another form of mounting the vent pipe. With reference to FIG. 4, a vent pipe **406*a* which is a bent pipe such as the L-shaped pipe is inserted from outside into a shell 411 of the heat exchanger 401 without fixing at least part of one end of the vent pipe to an upper tube sheet 408, one end of the bent pipe is disposed beneath the upper tube sheet and fixed on the shell 411** of the heat exchanger so as to allow discharging of the gas collected in the shell.

FIG. 5 is an explanatory diagram illustrating a method for connecting a vent pipe and a shell side fluid passing port. FIG. 5A is a drawing to explain an example of the method for connecting a pipeline. The outer end of a vent pipe 506 is through a flange 517 connected to a conduit that has lead from a shell side fluid passing port 505 through a valve 515. Further, by setting the pipeline on the outlet side at a level higher than an upper tube sheet 508 and consequently enabling the shell of the heat exchanger 501 to be kept in the state filled with the fluid, the gas collected in the upper part of the shell will be readily driven out of the heat exchanger 501 by adjusting the valve 515 as occasion demands and the gas will be subsequently discharged through a known discharging means such as a valve 513 disposed in the pipeline.

Figure 5A:
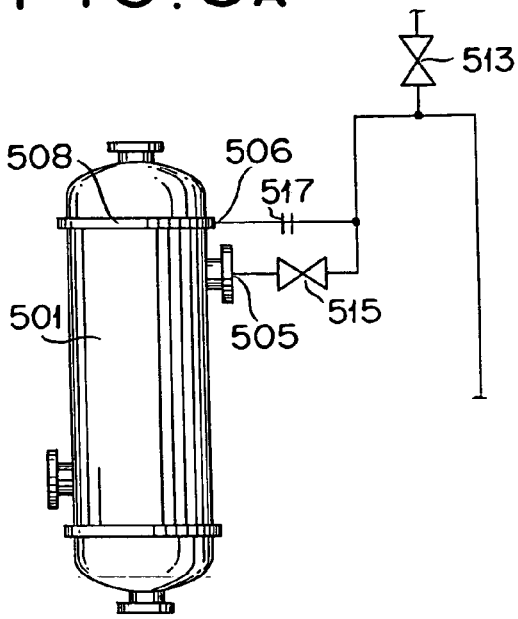
FIGS. 5A-D are explanatory diagrams for illustrating examples of the method for connecting a pipeline between a vent pipe and a shell side fluid passing port.
Figure 5B:
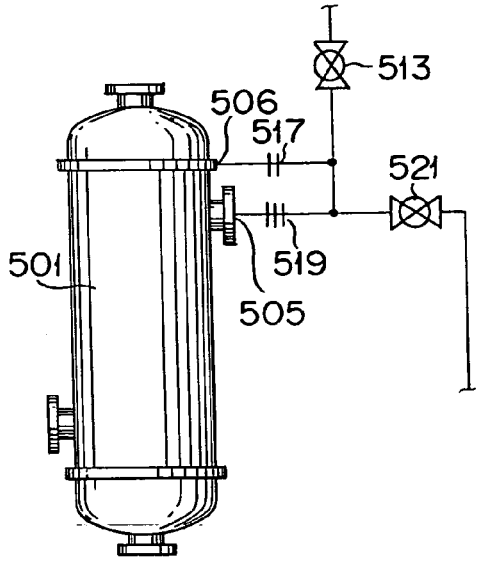

FIG. 5B is a drawing for explaining another example of the method for connecting the pipeline. The outer end of the vent pipe 506 is through the flange 517 connected to a conduit that has lead from the shell side fluid passing port 505 through an orifice 519. Since the vent pipe 506 assumes a pressed state owing to the orifice 519, the fluid flowing through the vent pipe 506 will be relatively increased in flow volume and consequently enabled to entrain the gas collected in the heat exchanger 501 and the gas so entrained by the fluid will be driven out by partly closing a valve 521 and opening a valve 513 both disposed in the pipeline.

Figure 5C:
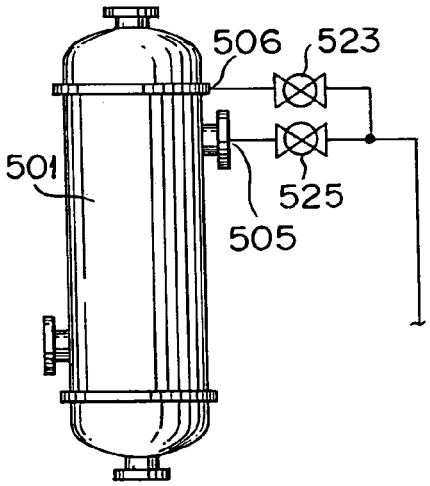

FIG. 5C is a drawing for explaining yet another example of the method for connecting the pipeline. The outer end of the vent pipe 506 is through a valve 523 connected to a conduit that has lead from the shell side fluid passing port 505 through a valve 525.

Figure 5D:
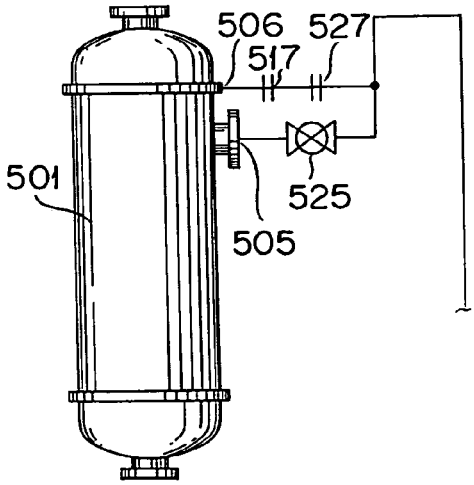

FIG. 5D is a drawing for explaining still another example of the method for connecting the pipeline. The outer end of the vent pipe 506 is through flanges 517 and 527 connected to a conduit that has lead from the shell side fluid passing port 505 through a valve 525. Further, since the pipeline on the outlet side is set at a level higher than the upper tube sheet and the shell of the heat exchanger 501 is kept in the state filled with the fluid, the gas collected in the upper part of the heat exchanger 501 will be readily driven out.

When the fluid is introduced into the heat exchanger 501 through the shell side fluid passing port 505 and the vent pipe 506 contrary to the above, the gas can be introduced through the flange 517 by squeezing a nozzle 515 illustrated in FIG. 5A, thereby the fluidity of the gas in the upper part of the heat exchanger 510 being exalted, and the overall heat transfer efficiency of the heat exchanger being improved.

As regards the construction illustrated in FIG. 5B, since the vent pipe 506 assumes a pressed state owing to the provision of the orifice 519, the fluid in the vent pipe 506 is enabled to increase the flow volume thereof relatively and exalt the fluidity thereof in the upper part of the shell of the heat exchanger 501.

In the constructions illustrated in FIGS. 5C and 5D, the flow volume of the fluid to the upper part of the shell of the heat exchanger 501 can be increased and the fluidity of the fluid in the upper part of the shell can be exalted by manipulating the valve 525.

Figure 6:
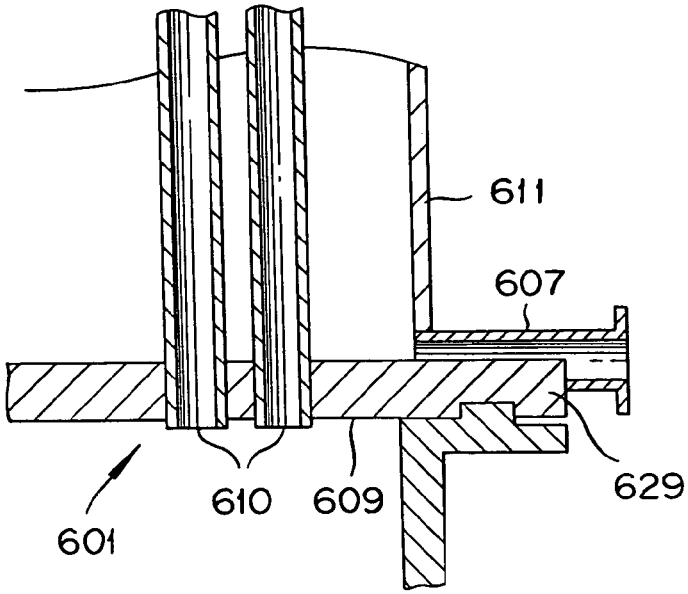
FIG. 6 is a partially cutaway longitudinal cross section of a shell-and-tube heat exchanger according to this invention.

FIG. 6 is a partially cutaway longitudinal cross section of the shell-and-tube heat exchanger according to this invention. Specifically, it is an explanatory diagram illustrating one position for mounting the drain pipe 607. With reference to FIG. 6, pluralities of tubes 610 are arrayed in the vertical direction, namely, parallelly to the shell 611 of the heat exchanger 601. One end of the drain pipe 607 is fitted through the medium of a flange 629 to a boundary between a lower tube sheet 609 and a shell 611 of the heat exchanger in the state allowing the inner surface of the drain pipe 607 to confront the lower tube sheet 609 and enabling the sludge, drain, etc. collected in the heat exchanger 601 to be discharged during a stop of the heat exchanger 601. Though one drain pipe is generally provided for heat exchanging, pluralities of drain pipes may be provided in consideration of the size of heat exchangers and the nature of fluids to be used.

Figure 7:
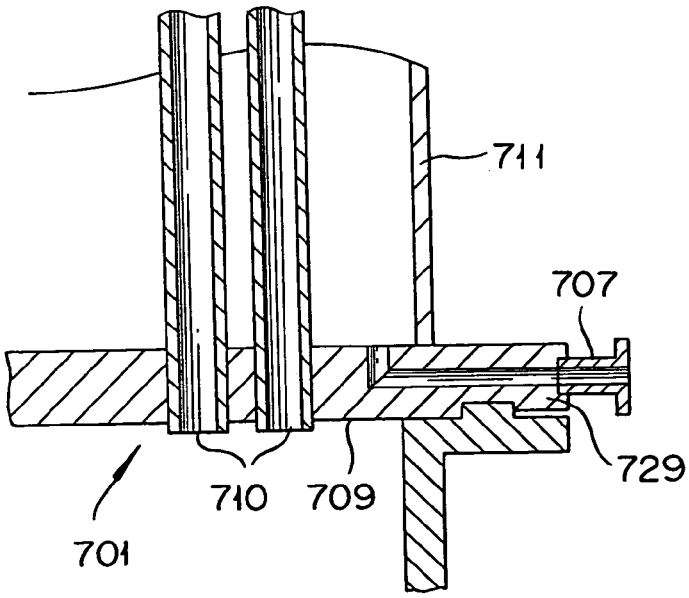
FIG. 7 is a partially cutaway longitudinal cross section of another shell-and-tube heat exchanger according to this invention.

FIG. 7 is a partially cutaway longitudinal cross section of another shell-and-tube heat exchanger according to this invention. Specifically, it is an explanatory diagram illustrating another position for mounting a drain pipe 707. With reference to FIG. 7, pluralities of tubes 710 are arrayed in the vertical direction, namely parallelly to a shell 711 of the heat exchanger 701. One end of the drain pipe 707, after passing through a flange 729 and a lower tube sheet 709 and reaching the interior of the heat exchanger 701, is fixed so as to permit discharging of the sludge and other matters collected in the heat exchanger during a stop of the heat exchanger 701.

Figure 8:
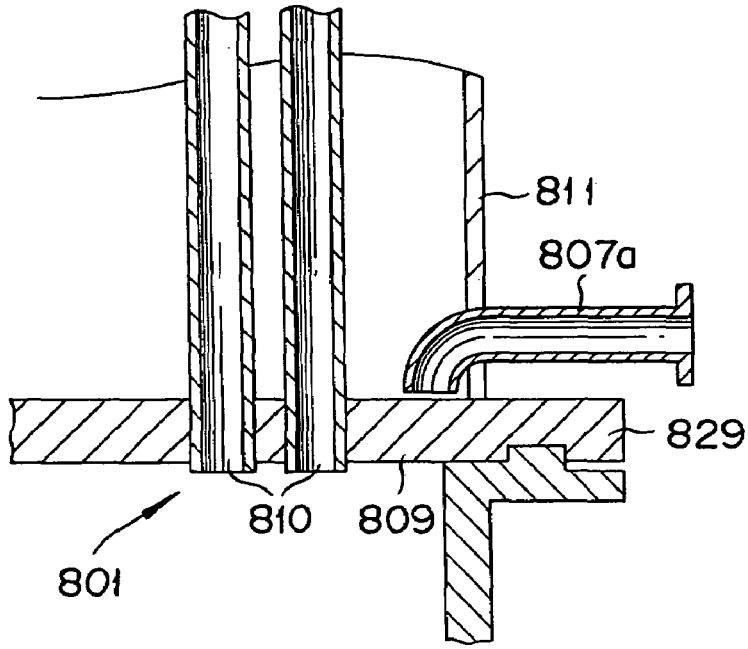
FIG. 8 is a partially cutaway longitudinal cross section of still another shell-and-tube heat exchanger according to this invention.

As regards the form of drain pipe, disposing one end of a bent pipe above the lower tube sheet may be cited besides the above. A drain pipe illustrated in FIG. 8 may be cited as an example. FIG. 8 is a partially cutaway longitudinal cross section of the shell-and-tube heat exchanger according to this invention. Specifically, it is an explanatory diagram illustrating another mode of mounting the drain pipe. With reference to FIG. 8, a drain pipe 807 which is a bent pipe such as the L-shaped pipe is inserted into a shell 811 of the heat exchanger 801 without fixing at least part of one end of the vent pipe to a lower tube sheet 809, one end of the bent pipe is disposed above the lower tube sheet 809 and fixed on the shell so as to allow discharging of the sludge accumulated in the lower part of the shell of the heat exchanger 801. Incidentally, the cut edge of the one end of the bent approximating closely to the lower tube sheet is not particularly restricted so long as it is capable of discharging the sludge accumulated in the shell. It may assume any arbitrary angle such as right angle or acute angle relative to the direction of length of the bent. The reference numerals 801 and 829 respectively denote a heat exchanger and a flange.

Figure 9:
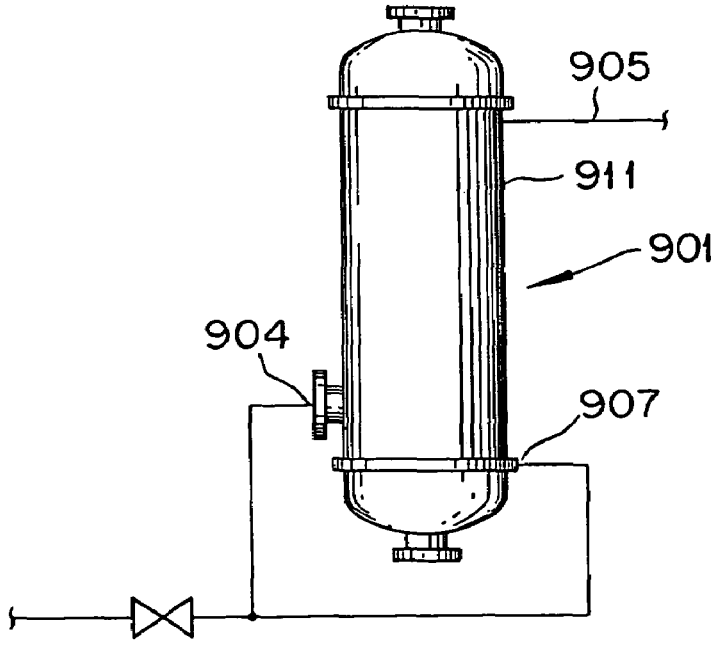
FIG. 9 is an explanatory diagram illustrating an example of the method for connecting a pipeline between a drain pipe and a shell side fluid passing port.

FIG. 9 is an explanatory diagram illustrating an example of connecting a pipeline between a drain pipe and a shell side fluid passing port. With reference to FIG. 9, the outer end of a drain pipe 907 is connected to a conduit that has passed through a first shell side fluid passing port 904. By introducing part of a refrigerant through the drain pipe 907, it is possible to give fluidity to the fluid in the lower part of the shell 911 of the heat exchanger 901 and improve the overall heat transfer efficiency of the heat exchanger 901. In particular when an easily polymerizable substance is passed through the tubes of the heat exchanger 901 to cool, the occurrence of a polymer has been heretofore observed on the tube. By improving the fluidity of the fluid in the lower part on the shell, it is possible to repress the formation of a polymer on the tubes.

When a vapor is introduced through a second shell side fluid passing port 905 disposed in the upper part of the shell 911 of the heat exchanger 901, the condensate, which is generated when the vapor is made to exchange heat with the shell side fluid, is generally discharged through the first shell side fluid passing port 904. By connecting the first shell side fluid passing port 904 and the drain pipe 907 with a pipeline and allowing the condensate to be discharged constantly through the drain pipe 907, however, it is possible to preclude piling up of the condensate, improve the heat transfer efficiency in the lower part of the shell, and improve the overall heat transfer efficiency of the heat exchanger 901.

Figure 10:
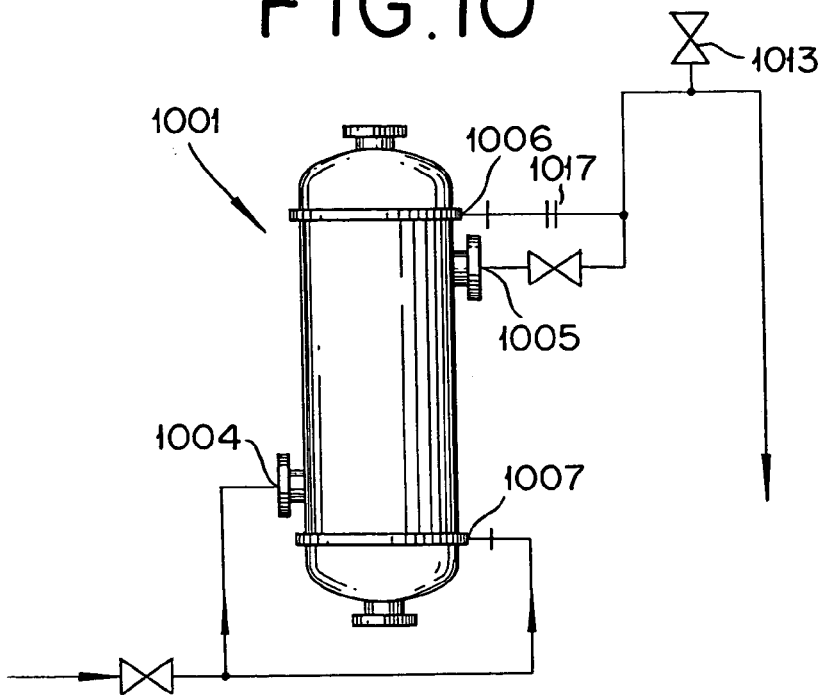
FIG. 10 is a diagram illustrating an example of another method of this invention for connecting a pipeline between a vent pipe and a shell side fluid passing port and a pipeline between a drain pipe and a shell side fluid passing port.

FIG. 10 is a drawing illustrating an example of connecting pipelines between a vent pipe and a shell side fluid passing port and between a drain pipe and the shell side fluid passing port. FIG. 10 depicts a combination of connecting a pipeline illustrated in FIG. 5A and a pipeline illustrated in FIG. 9. In FIG. 10, 1001 denotes a heat exchanger, 1004 a shell side fluid passing port, 1005 a shell side fluid passing port, 1006 a vent pipe, 1007 a drain pipe, 1013 a valve, and 1017 a flange.

Figure 11:
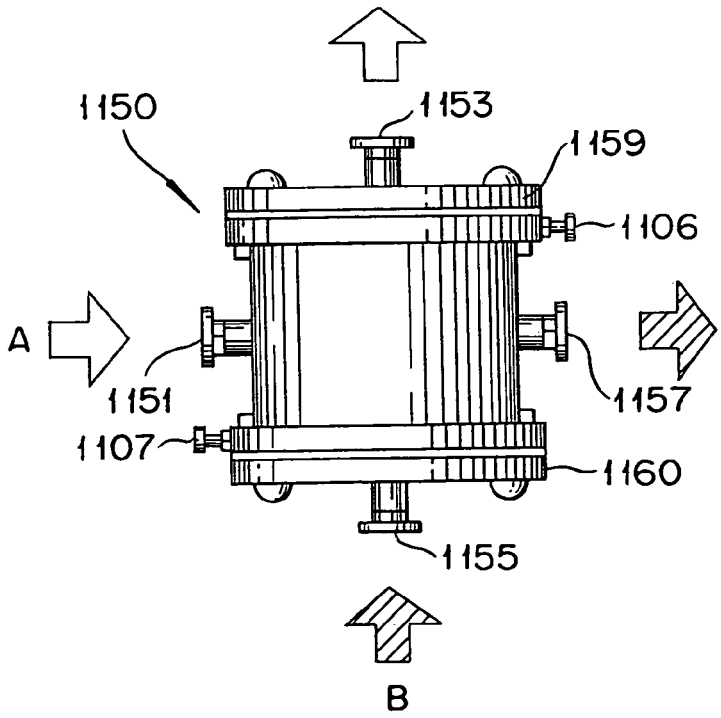
FIG. 11 is a diagram illustrating the directions of flow of fluids in the spiral heat exchanger according to this invention.

FIG. 11 is a drawing illustrating the flow direction of a fluid in the spiral heat exchanger 1150 according to this invention. With reference to FIG. 11, fluid A is introduced through a fluid A passing port 1151 disposed on the heat exchanger side (the shell in the case of the shell-and-tube heat exchanger) and discharged through a fluid A passing port 1153 disposed in the upper part of the heat exchanger, so that no stagnation of gas occurs in the heat exchanger 1150 and a bent is no longer necessary. As regards fluid B, however, this fluid is introduced through a fluid B passing port 1155 and discharged through another fluid B passing port 1157, so that the interior of the heat exchanger 1150, similarly in the shell-and-tube heat exchanger, generates a gas and gives rise to a portion making substantially no contribution to heat exchange above the heat exchanger 1150 and eventually degrades the heat transfer efficiency.

The vent pipe 1106 is needed for the purpose of discharging the stagnating gas. By fixing this vent pipe 1106 to an upper cover part 1159, it is possible to effect efficient discharge of the gas collected above the fluid B passing port through the vent pipe 1106 mounted on the upper cover part 1159.

The flow directions of fluids A and B are not limited to those of the example cited above. The method of introducing fluid A through the fluid B passing port 1157 and discharging it through the fluid A outlet 1153 and introducing the fluid B through the fluid A passing port 1151 and discharging it through the fluid B passing port 1155 or the method of introducing fluid A through the fluid A passing port 1151 and discharging it through the fluid B passing port 1155 and introducing the fluid B through the fluid A passing port 1153 and discharging it through the fluid B passing port 1157 may be cited as examples.

Figure 12:
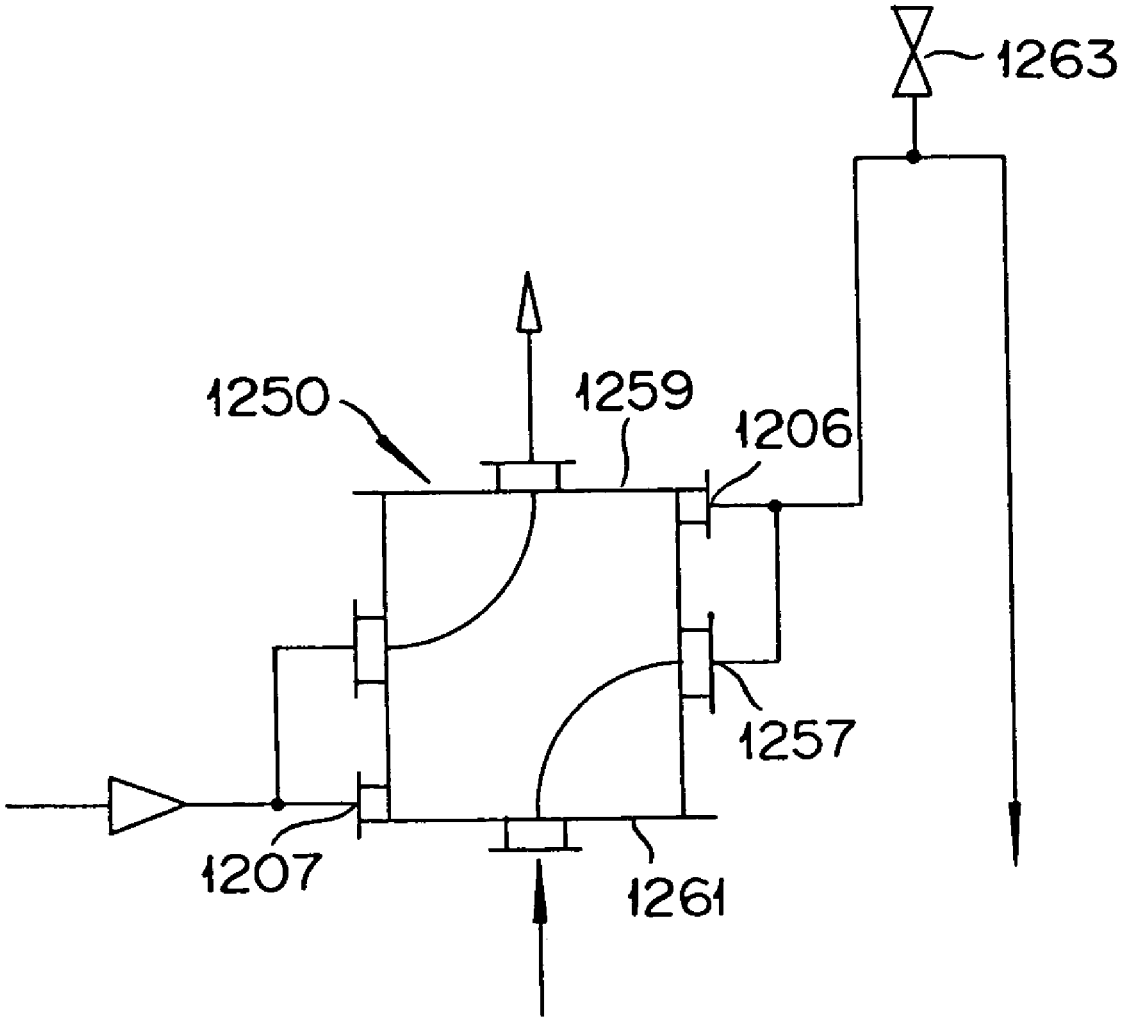
FIG. 12 is an explanatory diagram illustrating an example of the directions of flow of Fluid A and Fluid B according to this invention.

FIG. 12 is an explanatory diagram illustrating the flow directions of Fluids A and B. With reference to FIG. 12, by connecting a vent pipe 1206 and a fluid B passing port 1257 with a pipeline and further positioning the pipeline on the outlet side at a level higher than an upper cover 1259 of a heat exchanger 1250, it is possible to exert a back pressure to bear on the outlet side and discharge the gas collected in the heat exchanger 1250, eliminating stagnation of gas in the heat exchanger 1250, repress the decrease of the heating surface area due to the presence of a gas, and improve the heat transfer efficiency. Further, the corrosion, which has occurred heretofore in a gas-liquid boundary part of the heat exchanger 1250, can be repressed by providing the vent pipe 1206 on the upper cover part and filling the interior of the heat exchanger 1250 to capacity with the fluid. Thus, the resistance to corrosion can be improved.

Further, by allowing part of fluid A to flow through the drain pipe 1207, it is possible to impart improved fluidity to the fluid in the lower part of the heat exchanger 1250 and improve the overall heat transfer efficiency of the heat exchanger 1250. In particular, when an easily polymerizable substance is heated or cooled, a polymer has heretofore occurred in the lower cover part of the heat exchanger 1250. By improving the fluidity of the fluid in the lower part of the heat exchanger as in the present example, the formation of a polymer in the lower cover part 1260 of the heat exchanger can be repressed.

Of course, the mode of substituting a bent pipe for the conventional vent pipe or drain pipe can be applied similarly to the spiral heat exchangers.

EXAMPLES

Now, this invention will be described more specifically below with reference to examples. These examples are intended to explain the present invention and do not restrict the content of the present invention.

Example 1

A pipeline illustrated in FIG. 10 was laid by using a vertical shell-and-tube heat exchanger with a vent pipe as illustrated in FIG. 3 and a drain pipe as illustrated in FIG. 7.

This heat exchanger satisfied D/(d×N)=19 {Formula: 950/(25×2)=19}.

The particulars of the heat exchanger used herein were as follows:

Type of heat exchanger: Vertical shell-and-tube heat exchanger (condenser)
Pipe side (high-temperature side) fluid: Butyl acrylate
Shell side (low-temperature side) fluid: Water
High-temperature side fluid inlet temperature: 70° C.
Low-temperature side fluid inlet temperature: 30° C.
High-temperature side fluid outlet temperature: 65° C. (overcooled to 5° C.)
Heating surface area: 105 $m^2$
Shell diameter: 950 mm
Two vent pipes: 25 mm in inside diameter
One drain pipe: 25 mm in inside diameter
Material: SUS 316
Angle formed by low-temperature side fluid inlet port and drain pipe with the direction of axis: 45°
Angles formed by low-temperature side fluid outlet port and drain pipe with the direction of axis: 45° and 180°
Flow volume of high-temperature side fluid: 10850 kg/hr
Flow volume of low-temperature side fluid: 110 $m^3$/hr.

When the heat exchanger described above was used to effect heat exchange by flowing 1 vol. % of the shell side fluid through the drain pipe and 2 vol. % of the shell side fluid through the vent pipe, the output temperature of the low-temperature side fluid fell to 40° C. When the operation of the heat exchanger was continued for six months under the conditions described above, the visual inspection of the interior of the heat exchanger detected no sign of either accumulation of sludge in the lower tube sheet or corrosion of the heat transfer tube in the proximity of the upper tube sheet.

No sign of the generation of a polymer was detected on the pipe side.

Comparative Example 1

In a vertical shell-and-tube heat exchanger with a vent pipe and a drain pipe as illustrated in FIG. 1, the gas was expelled with the vent pipe 6 and the drain pipe 7 not connected to the pipeline and the drain pipe simply retained in a closed state and the vent pipe 6 retained in an opened state. The other conditions of the operation were the same as those used in Example 1.

In the operation of the heat exchanger mentioned above, the low-temperature side outlet temperature was 38.5° C. and the high-temperature side outlet temperature was 70° C., so that the heat transfer efficiency was low as compared with the operation of Example 1. The open inspection of the heat exchanger performed after six months' operation detected accumulation of sludge in the lower tube sheet and rough skin by corrosion on the outer surface of the heat transfer tube. Further, a polymer was suffered to occur on the tube and in the proximity of the upper tube sheet and accumulate in the lower tube sheet possibly because of poor fluidity of the fluid.

Comparative Example 2

In a vertical shell-and-tube heat exchanger with a vent pipe as illustrated in FIG. 2 and a drain pipe as illustrated in FIG. 6, the gas was expelled with the vent pipe 206 and the drain pipe 607 not connected to the pipeline and the drain pipe 607 simply retained in a closed state and the vent pipe 206 retained in an opened state. Thereafter, the operation was continued with the drain pipe 607 and the vent pipe 206 both retained in a closed state. The other conditions of the operation were the same as those used in Example 1.

In the operation of the heat exchanger mentioned above, the low-temperature side outlet temperature was 39° C. and the high-temperature side outlet temperature was 68° C. (overcooled to 2° C.), so that the heat transfer efficiency was low as compared with the operation of Example 1. The open inspection of the heat exchanger performed after six months' operation detected accumulation of sludge in the lower tube sheet and rough skin by corrosion on the outer surface of the heat transfer tube. Further, a polymer was suffered to occur on the tube side and in the proximity of the upper tube sheet and accumulate in the lower tube sheet part possibly because of poor fluidity of the fluid.

Example 2

A pipeline illustrated in FIG. 10 was laid by using a vertical shell-and-tube heat exchanger with a vent pipe as illustrated in FIG. 4 and a drain pipe as illustrated in FIG. 8.

This heat exchanger satisfied D/(d×N)=24 {Formula: 600/(25×1)=24}.

The particulars of the heat exchanger used herein were as follows:

Type of heat exchanger: Vertical shell-and-tube heat exchanger (refrigerator)

Tube side (high-temperature side) fluid: Aqueous acrylic acid solution

Shell side (low-temperature side) fluid: Water

High-temperature side fluid inlet temperature: 100° C.

Low-temperature side fluid inlet temperature: 37° C.

High-temperature side fluid outlet temperature: 57° C.

Heating surface area: 50 $m^2$

Shell diameter: 600 mm

One vent pipe: 25 mm in inside diameter

One drain pipe: 25 mm in inside diameter

Material: SUS 316

Flow volume of high-temperature side fluid: 5.5 $m^3$/hr

Flow volume of low-temperature side fluid: 4.8 $m^3$/hr

Angle formed by low-temperature side fluid inlet port and drain pipe with the direction of axis: 30°

Angle formed by low-temperature side fluid outlet port and drain pipe with the direction of axis: 30°.

When the heat exchanger described above was used to perform heat exchange by flowing 0.5 vol. % of the shell side fluid through the drain pipe and 1 vol. % of the shell side fluid through the vent pipe, the output temperature of the low-temperature side fluid rose to 83° C. When the operation of the heat exchanger was continued for six months under the conditions described above, the visual inspection of the interior of the heat exchanger detected no sign of either accumulation of sludge in the lower tube sheet or corrosion of the heat transfer tube in the proximity of the upper tube sheet.

No sign of the generation of a polymer was detected on the tube side.

Comparative Example 3

In a vertical shell-and-tube heat exchanger with a vent pipe and a drain pipe as illustrated in FIG. 1, the gas was expelled with the vent pipe 6 and the drain pipe 7 not connected to the pipeline and the drain pipe simply retained in a closed state and the vent pipe 6 retained in an opened state. The other conditions of the operation were the same as those used in Example 1.

In the operation of the heat exchanger mentioned above, the low-temperature side outlet temperature was 81° C. and the high-temperature side outlet temperature was 58.5° C., so that the heat transfer efficiency was low as compared with the operation of Example 2. The open inspection of the heat exchanger performed after six months' operation detected accumulation of sludge in the lower tube sheet and rough skin by corrosion on the outer surface of the heat transfer tube. Further, a polymer was suffered to occur on the tube side and in the proximity of the upper tube sheet and accumulate in the lower tube sheet possibly because of poor fluidity of the fluid.

The entire disclosure of Japanese Patent Application No. 11-316504 filed on Nov. 8, 1999 including specification, claims, drawings and summary are incorporated herein by reference in its entirety.

What is claimed is:

1. A vertical tube and shell heat exchanger comprising:

a pair of first fluid passing ports for flow of a first fluid through at least one vertical tube;

an upper tube sheet through which the at least one vertical tube passes;

a pair of second fluid passing ports for flow of a second fluid through the vertical shell; and a vent pipe having two ends, for venting a gas, the gas locating to the upper portion of the vertical shell during operation of the vertical tube and shell heat exchanger, at least part of one end of the vent pipe being made of the upper tube sheet and being fixed to the boundary between the upper tube sheet and the vertical shell and the other end of the vent pipe being fluidly connected outside the tube and shell heat exchanger to a second fluid passing port passing the same fluid as the vent pipe, whereby the fluid flowing through the vent pipe drives out the gas, wherein the fluid connection of the vent pipe with the second fluid passing port is further in fluid communication with a pipeline downstream of the fluid connection, the pipeline having at least a portion at a level higher than the upper tube sheet and which comprises a valve located at the high portion thereof, configured to expel the gas.

2. The vertical tube and shell heat exchanger of claim 1 further comprising:

a drain pipe at least part of one end of which is made of a lower tube sheet part and reaches the interior of the vertical shell and the other end of which is connected outside the vertical tube and shell heat exchanger to a lower one of the second fluid passing ports passing the same fluid as the drain pipe.

3. A vertical tube and shell heat exchanger according to claim 2, further comprising a first source of the first fluid, the first source being fluidly connected to a first fluid passing port of said pair of first fluid passing ports, and a second source of the second fluid, the second source being fluidly connected to a second fluid passing port of said pair of second fluid passing ports, wherein the first fluid comprises a polymerizable substance and is passed through the first fluid passing port of the heat exchanger and the second fluid comprises a low temperature fluid and is introduced to the second fluid passing port as coolant.

4. A vertical tube and shell heat exchanger according to claim 3, configured such that when the second fluid flowing through the shell is introduced or discharged through the drain pipe instead of through the second fluid passing port, the second fluid in the lower part of the heat exchanger is stirred as it is fluidized.

* * * * *